US007415826B2

(12) United States Patent
McMasters et al.

(10) Patent No.: US 7,415,826 B2
(45) Date of Patent: Aug. 26, 2008

(54) FREE FLOATING MIXER ASSEMBLY FOR COMBUSTOR OF A GAS TURBINE ENGINE

(75) Inventors: Marie Ann McMasters, Mason, OH (US); David Allen Kastrup, West Chester, OH (US)

(73) Assignee: General Electric Company, Schenectady, NY (US)

( * ) Notice: Subject to any disclaimer, the term of this patent is extended or adjusted under 35 U.S.C. 154(b) by 499 days.

(21) Appl. No.: 11/188,482

(22) Filed: Jul. 25, 2005

(65) Prior Publication Data

US 2007/0028620 A1 Feb. 8, 2007

(51) Int. Cl.
*F23R 3/14* (2006.01)

(52) U.S. Cl. ..... 60/748; 60/752

(58) Field of Classification Search ..... 60/737, 60/738, 748, 752, 796, 800
See application file for complete search history.

(56) References Cited

U.S. PATENT DOCUMENTS 4,763,482 A 8/1988 Wehner
5,916,142 A * 6/1999 Snyder et al. ..... 60/748
6,354,072 B1 3/2002 Hura
6,363,726 B1 4/2002 Durbin et al.
6,367,262 B1 4/2002 Mongia et al.
6,381,964 B1 5/2002 Pritchard, Jr. et al.
6,418,726 B1 7/2002 Foust et al.
6,427,435 B1 8/2002 Patterson et al.
6,453,660 B1 9/2002 Johnson et al.
6,484,489 B1 11/2002 Foust et al.
6,865,889 B2 3/2005 Mancini et al.
6,976,363 B2 * 12/2005 McMasters et al. ..... 60/800
7,062,920 B2 * 6/2006 McMasters et al. ..... 60/800

* cited by examiner

*Primary Examiner*—L. J. Casaregola
(74) *Attorney, Agent, or Firm*—William Scott Andes; James P. Davidson

(57) ABSTRACT

A combustor dome assembly for a gas turbine engine having a longitudinal centerline axis extending therethrough, including: an annular dome plate having an inner portion, an outer portion, a forward surface and a plurality of circumferentially spaced openings formed therein, wherein a radial section is defined between each adjacent opening; and, a mixer assembly located upstream of and in substantial alignment with each of the openings in the dome plate, with the mixer assembly including a forward portion and an aft portion. Each mixer assembly is retained in a manner so as to be movable in a radial and axial direction without obstructing the radial sections of the dome plate. A first pair of tabs are positioned on the forward surface of the dome plate adjacent each opening and a second pair of tabs are positioned on the aft portion of each mixer assembly, wherein the dome plate tabs interface with the mixer assembly tabs to prevent rotation of each mixer assembly.

16 Claims, 7 Drawing Sheets

FREE FLOATING MIXER ASSEMBLY FOR COMBUSTOR OF A GAS TURBINE ENGINE

BACKGROUND OF THE INVENTION

The present invention relates generally to a staged combustion system in which the production of undesirable combustion product components is minimized over the engine operating regime and, in particular, to a combustion system having a plurality of free floating mixer assemblies which are independently retained in position with respect to a corresponding opening in the dome plate in a manner so as to be prevented from rotating while being movable in a radial and axial direction.

Air pollution concerns worldwide have led to stricter emissions standards both domestically and internationally. Aircraft are govemed by both Environmental Protection Agency (EPA) and International Civil Aviation Organization (ICAO) standards. These standards regulate the emission of oxides of nitrogen (NOx), unburned hydrocarbons (HC), and carbon monoxide (CO) from aircraft in the vicinity of airports, where they contribute to urban photochemical smog problems. Such standards are driving the design of gas turbine engine combustors, which also must be able to accommodate the desire for efficient, low cost operation and reduced fuel consumption. In addition, the engine output must be maintained or even increased.

It will be appreciated that engine emissions generally fall into two classes: those formed because of high flame temperatures (NOx) and those formed because of low flame temperatures which do not allow the fuel-air reaction to proceed to completion (HC and CO). Balancing the operation of a combustor to allow efficient thermal operation of the engine, while simultaneously minimizing the production of undesirable combustion products, is difficult to achieve. In that regard, operating at low combustion temperatures to lower the emissions of NOx can also result in incomplete or partially incomplete combustion, which can lead to the production of excessive amounts of HC and CO, as well as lower power output and lower thermal efficiency. High combustion temperature, on the other hand, improves thermal efficiency and lowers the amount of HC and CO, but oftentimes results in a higher output of NOx.

One way of minimizing the emission of undesirable gas turbine engine combustion products has been through staged combustion. In such an arrangement, the combustor is provided with a first stage burner for low speed and low power conditions so the character of the combustion products is more closely controlled. A combination of first and second stage burners is provided for higher power output conditions, which attempts to maintain the combustion products within the emissions limits.

Another way that has been proposed to minimize the production of such undesirable combustion product components is to provide for more effective intermixing of the injected fuel and the combustion air. In this way, burning occurs uniformly over the entire mixture and reduces the level of HC and CO that results from incomplete combustion. While numerous mixer designs have been proposed over the years to improve the mixing of the fuel and air, improvement in the levels of undesirable NOx formed under high power conditions (i.e., when the flame temperatures are high) is still desired.

One mixer design that has been utilized is known as a twin annular premixing swirler (TAPS), which is disclosed in the following U.S. Pat. Nos. 6,354,072; 6,363,726; 6,367,262; 6,381,964; 6,389,815; 6,418,726; 6,453,660; 6,484,489; and, 6,865,889. Published U.S. patent application 2002/0,178,732 also depicts certain embodiments of the TAPS mixer. It will be understood that the TAPS mixer assembly includes a pilot mixer which is supplied with fuel during the entire engine operating cycle and a main mixer which is supplied with fuel only during increased power conditions of the engine operating cycle. While improvements in NOx emissions during high power conditions are of current pinmary concern, modification of the main mixer in the assembly is needed to maintain the mixer assembly in proper position.

It is well known within the combustor art of gas turbine engines that a dome portion, in conjunction with inner and outer liners, serves to form the boundary of a combustion chamber. The annular combustor dome also serves to position a plurality of mixers in a circumferential manner so that a fuel/air mixture is provided to the combustion chamber in a desired manner. While the typical combustor arrangement has adequate space between swirler cups to incorporate features to enhance the spectacle plate structure (e.g., the addition of ribs, cooling holes and the like), certain geometric restrictions have been introduced by current combustor designs utilizing the TAPS mixer. As disclosed in U.S. Pat. No. 6,381,964 to Pritchard, Jr. et al., the size of the fuel nozzle and the corresponding swirler assembly associated therewith, has increased significantly from those previously utilized and thereby reduced the distance between adjacent swirler cups. Utilization of an annular dome plate having a greater diameter would serve to increase the weight of the engine and require modification of components interfacing therewith. Thus, the openings in the dome plate have been enlarged and thereby lessened the circumferential distance between adjacent openings.

One combustor dome assembly design including a floating swirler is disclosed in a patent application entitled "Combustor Dome Assembly Of A Gas Turbine Engine Having A Free Floating Swirler," having Ser. No. 10/638,597, which is owned by the assignee of the present invention. As seen therein, tab members are associated with the outer and inner cowls to restrict radial and axial movement of the swirlers to a predetermined amount. Alternatively, separate tab members are provided which interface with the connections of the dome plate, liners and cowls. While such tab members are able to perform their intended function, their positioning upstream of the swirler is not practical for the mixer assembly of the current design.

In yet another known combustor dome assembly, anti-rotation tab members for a mixer assembly are located only on the mixer itself and interface with the tab members of mixer assemblies located adjacent thereto. It has been found that this configuration is subject to an offset between the mixer assembly and the corresponding opening in the dome plate, which may be caused by vibrations experienced by the adjacent mixer assemblies or machining errors. Further, cooling holes in the radial section of the dome plate between adjacent openings tend to be obstructed, which has increased the temperature of the deflector plate located downstream thereof to by an amount that has affected the life of the deflector plate.

Accordingly, it would be desirable for a mechanism to be developed in association with the current dome and mixer assembly design which prevents rotation of the mixer assembly. It would also be desirable for such mechanism to permit the mixer assembly to have a predetermined amount of axial and radial movement.

BRIEF SUMMARY OF THE INVENTION

In a first exemplary embodiment of the invention, a combustor dome assembly for a gas turbine engine is disclosed as having a longitudinal centerline axis extending therethrougb. The combustor dome assembly includes: an annular dome plate having an inner portion, an outer portion, a forward surface and a plurality of circumferentially spaced openings formed therein, wherein a radial section is defined between each adjacent opening, a mixer assembly located upstream of and in substantial alignment with each of the openings in the dome plate, where the mixer assembly includes an upstream portion and a downstream portion; and, a mechanism to prevent rotation of each mixer assembly. In this way, each mixer assembly is retained in a manner so as to be movable in a radial and axial direction without obstructing the radial sections of the dome plate. In addition, the combustor dome assembly further includes a first pair of tab members extending upstream from the forward surface of the dome plate adjacent each opening and a second pair of tab members extending outwardly from the downstream portion of each mixer assembly, wherein the dome plate tab members interface with the mixer assembly tab members to prevent rotation of each mixer assembly.

DETAILED DESCRIPTION OF THE INVENTION

Figure 1:
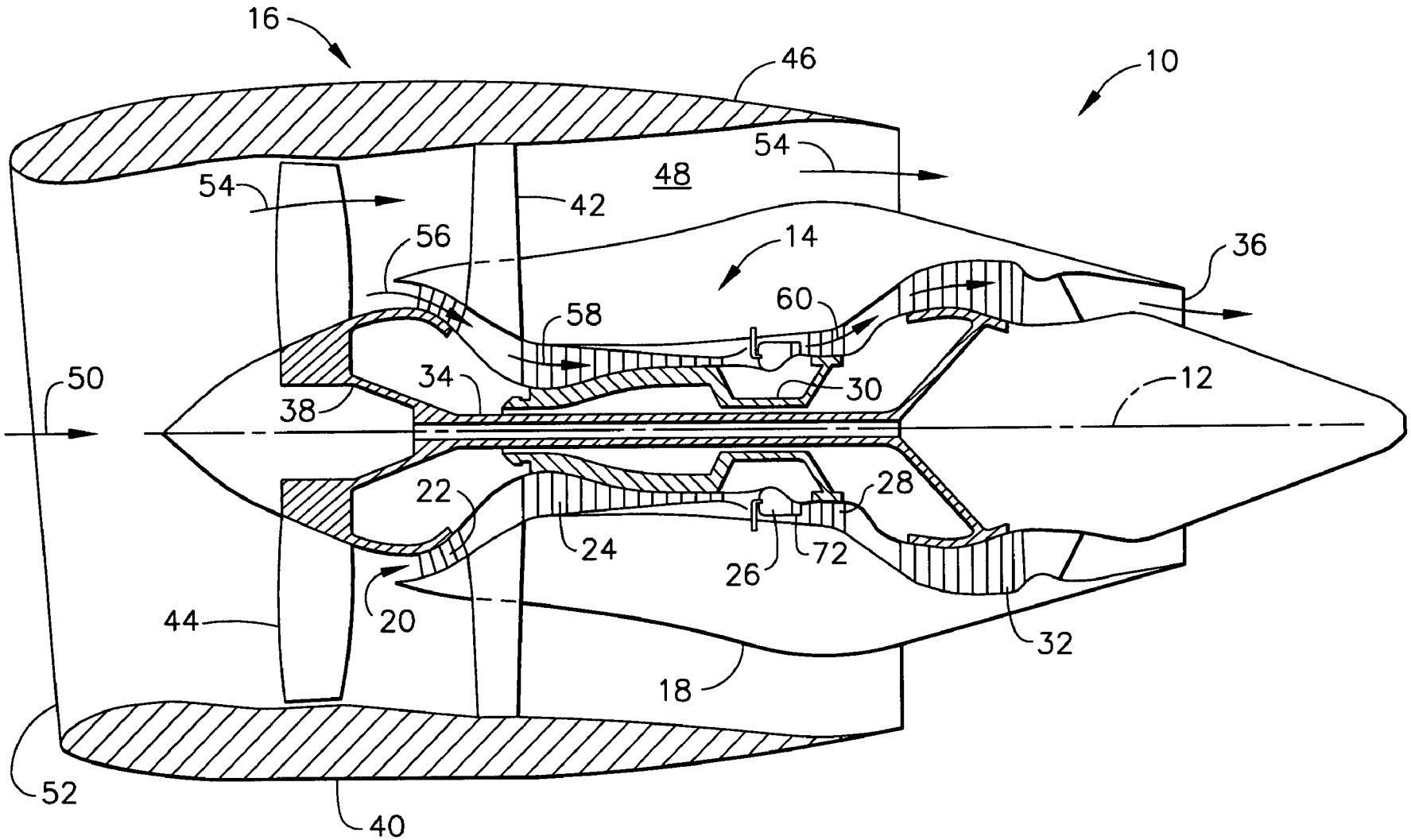
FIG. 1 is a diagrammatic view of a high bypass turbofan gas turbine engine.

Referring now to the drawings in detail, wherein identical numerals indicate the same elements throughout the figures, FIG. 1 depicts in diagrammatic form an exemplary gas turbine engine 10 (high bypass type) utilized with aircraft having a longitudinal or axial centerline axis 12 therethrough for reference purposes. Engine 10 preferably includes a core gas turbine engine generally identified by numeral 14 and a fan section 16 positioned upstream thereof. Core engine 14 typically includes a generally tubular outer casing 18 that defines an annular inlet 20. Outer casing 18 further encloses and supports a booster compressor 22 for raising the pressure of the air that enters core engine 14 to a first pressure level. A high pressure, multi-stage, axial-flow compressor 24 receives pressurized air from booster 22 and further increases the pressure of the air. The pressurized air flows to a combustor 26, where fuel is injected into the pressurized air stream to raise the temperature and energy level of the pressurized air. The high energy combustion products flow from combustor 26 to a first (high pressure) turbine 28 for driving high pressure compressor 24 through a first (high pressure) drive shaft 30, and then to a second (low pressure) turbine 32 for driving booster compressor 22 and fan section 16 through a second (low pressure) drive shaft 34 that is coaxial with first drive shaft 30. After driving each of turbines 28 and 32, the combustion products leave core engine 14 through an exhaust nozzle 36 to provide propulsive jet thrust.

Fan section 16 includes a rotatable, axial-flow fan rotor 38 that is surrounded by an annular fan casing 40. It will be appreciated that fan casing 40 is supported from core engine 14 by a plurality of substantially radially-extending, circumferentially-spaced outlet guide vanes 42. In this way, fan casing 40 encloses fan rotor 38 and fan rotor blades 44. Downstream section 46 of fan casing 40 extends over an outer portion of core engine 14 to define a secondary, or bypass, airflow conduit 48 that provides additional propulsive jet thrust.

From a flow standpoint, it will be appreciated that an initial air flow, represented by arrow 50, enters gas turbine engine 10 through an inlet 52 to fan casing 40. Air flow 50 passes through fan blades 44 and splits into a first compressed air flow (represented by arrow 54) that moves through conduit 48 and a second compressed air flow (represented by arrow 56) which enters booster compressor 22. The pressure of second compressed air flow 56 is increased and enters high pressure compressor 24, as represented by arrow 58. After mixing with fuel and being combusted in combustor 26, combustion products 60 exit combustor 26 and flow through first turbine 28. Combustion products 60 then flow through second turbine 32 and exit exhaust nozzle 36 to provide thrust for gas turbine engine 10.

Figure 2:
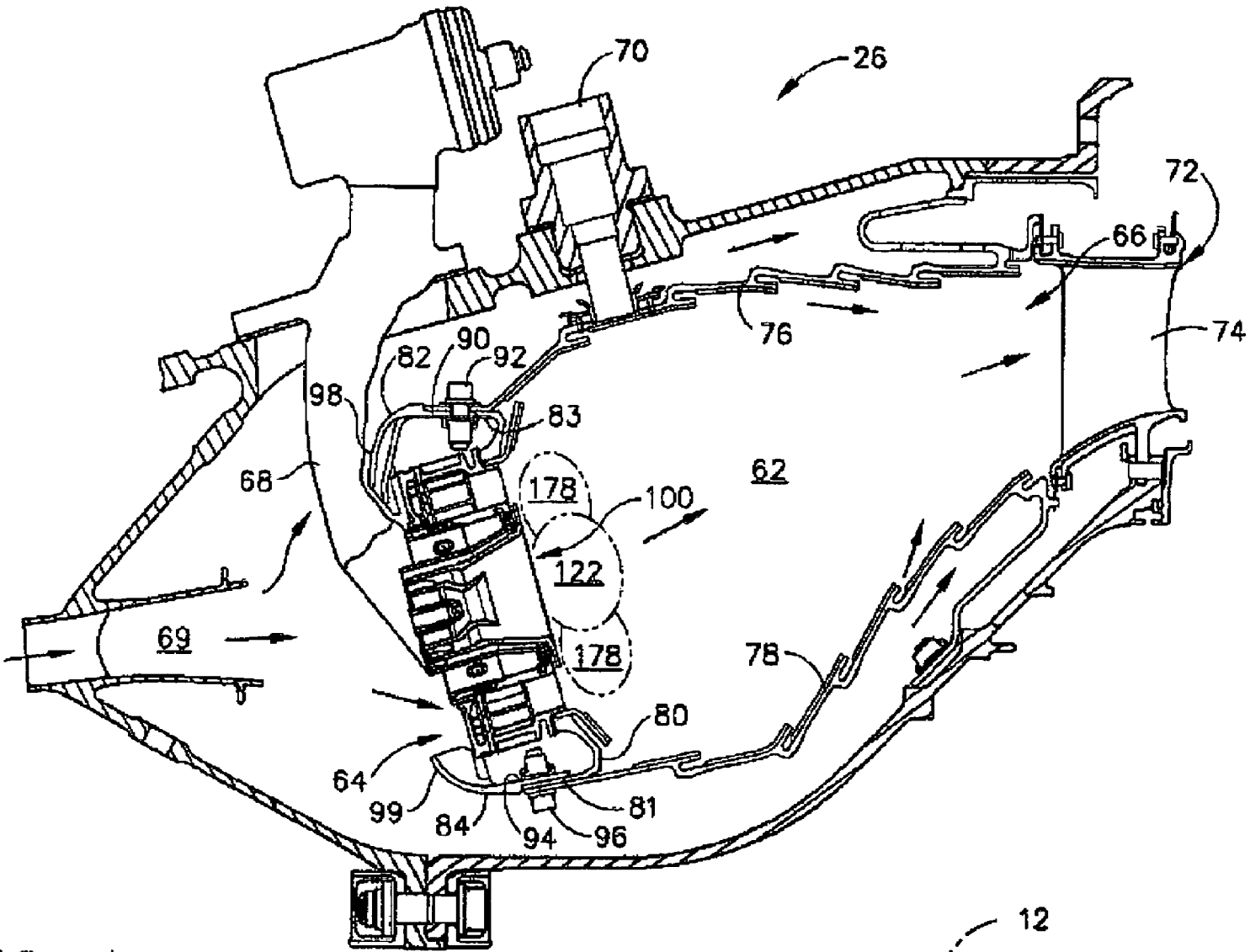
FIG. 2 is a longitudinal, cross-sectional view of a gas turbine engine combustor having a staged arrangement.

As best seen in FIG. 2, combustor 26 includes an annular combustion chamber 62 that is coaxial with longitudinal axis 12, as well as an inlet 64 and an outlet 66. As noted above, combustor 26 receives an annular stream of pressurized air from a high pressure compressor discharge outlet 69. A portion of this compressor discharge air flows into a mixing assembly 100, where fuel is also injected from a fuel nozzle 68 to mix with the air and form a fuel-air mixture that is provided to combustion chamber 62 for combustion. Ignition of the fuel-air mixture is accomplished by a suitable igniter 70, and the resulting combustion gases 60 flow in an axial direction toward and into an annular, first stage turbine nozzle 72. Nozzle 72 is defined by an annular flow channel that includes a plurality of radially-xtending, circularly-spaced nozzle vanes 74 that turn the gases so that they flow angularly and impinge upon the first stage turbine blades of first turbine 28. As shown in FIG. 1, first turbine 28 preferably rotates high pressure compressor 24 via first drive shaft 30. Low pressure turbine 32 preferably drives booster compressor 24 and fan rotor 38 via second drive shaft 34.

Combustion chamber 62 is housed within engine outer casing 18 and is defined by an annular combustor outer liner 76 and a radially-inwardly positioned annular combustor inner liner 78. The arrows in FIG. 2 show the directions in which compressor discharge air flows within combustor 26. As shown, part of the air flows over the outermost surface of outer liner 76, part flows into combustion chamber 62, and part flows over the innermost surface of inner liner 78.

Contrary to previous designs, it is preferred that outer and inner liners 76 and 78, respectively, not be provided with a plurality of dilution openings to allow additional air to enter combustion chamber 62 for completion of the combustion process before the combustion products enter turbine nozzle 72. This is in accordance with a patent application entitled "High Pressure Gus Turbine Engine Having Reduced Emissions, having Ser. No. 11,188,483 filed concurrently herewith and hereby incorporated by reference, which is also owned by the assignee of the present invention. It will be understood, however, that outer liner 76 and inner liner 78 preferably include a plurality of smaller, circularly-spaced cooling air apertures (not shown) for allowing some of the air that flows along the outermost surfaces thereof to flow into the interior of combustion chamber 62. Those inwardly-directed air flows pass along the inner surfaces of outer and inner liners 76 and 78 that face the interior of combustion chamber 62 so that a film of cooling air is provided therealong.

It will be understood that a plurality of axially-extending mixing assemblies 100 are disposed in a circular array at the upstream end of combustor 26 and extend into inlet 64 of annular combustion chamber 62. It will be seen that an annular dome plate 80 extends inwardly and forwardly to define an upstream end of combustion chamber 62 and has a plurality of circumferentially spaced openings 87 formed therein for receiving mixing assemblies 100. For their part, upstream portions of each of inner and outer liners 76 and 78, respectively, are spaced from each other in a radial direction and define an outer cowl 82 and an inner cowl 84. The spacing between the forwardmost ends of outer and inner cowls 82 and 84 defines combustion chamber inlet 64 to provide an opening to allow compressor discharge air to enter combustion chamber 62.

Figure 3:
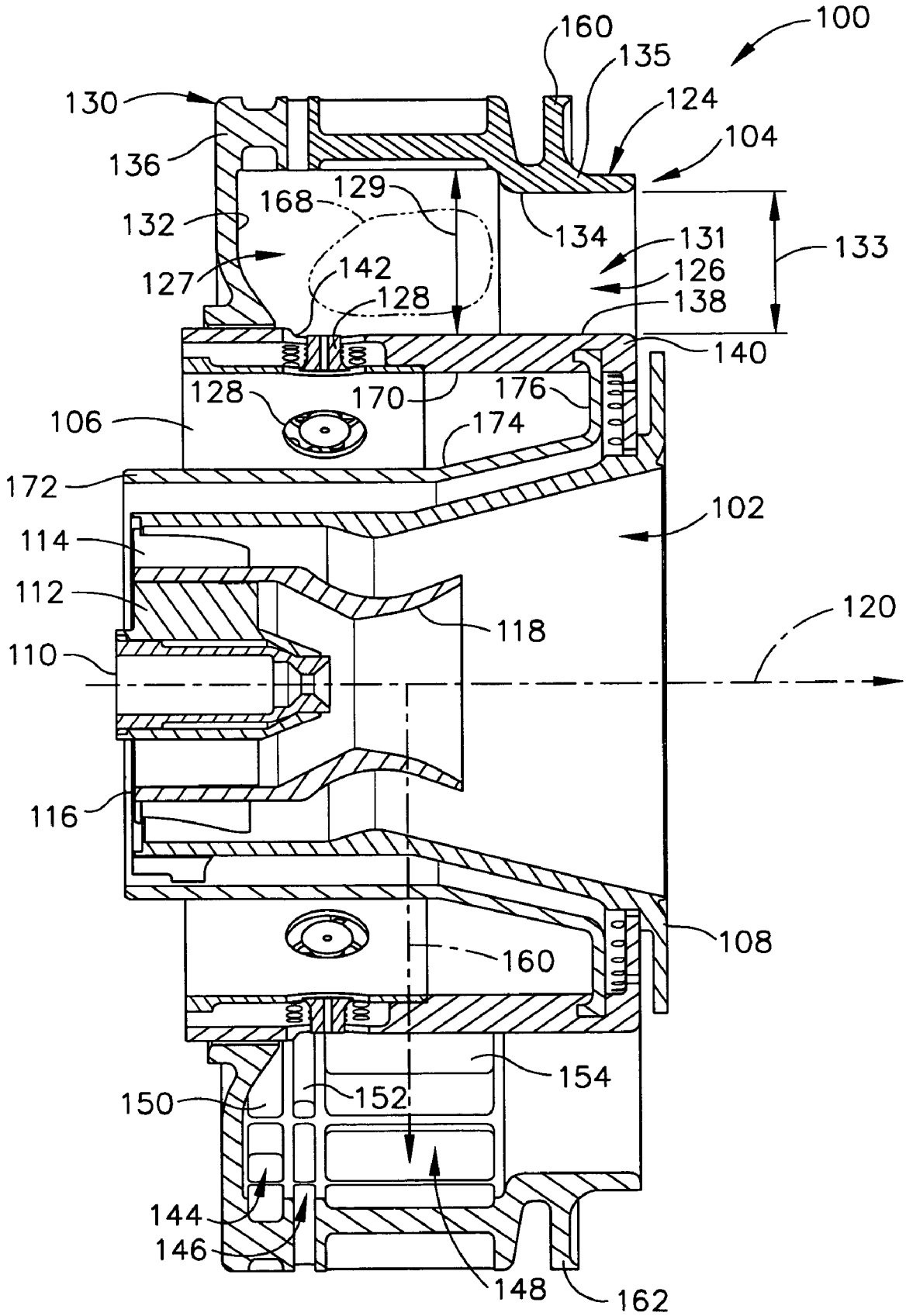
FIG. 3 is an enlarged, cross-sectional view of the mixer assembly depicted in FIG. 2.
Figure 4:
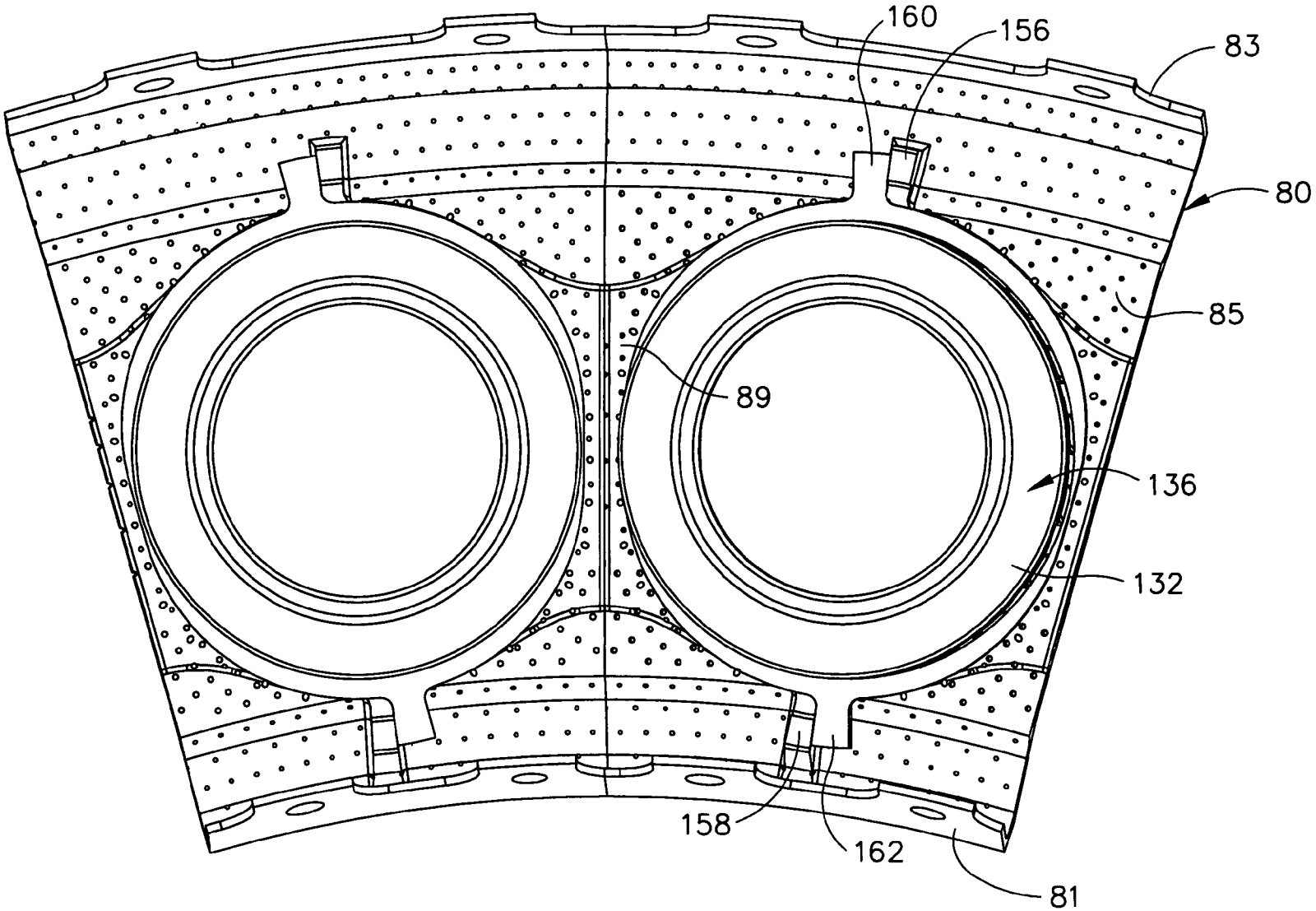
FIG. 4 is a partial front view of the combustor dome assembly depicted in FIG. 2, where certain components have been omitted to view the anti-rotation features of the dome plate and mixer assemblies.
Figure 5:
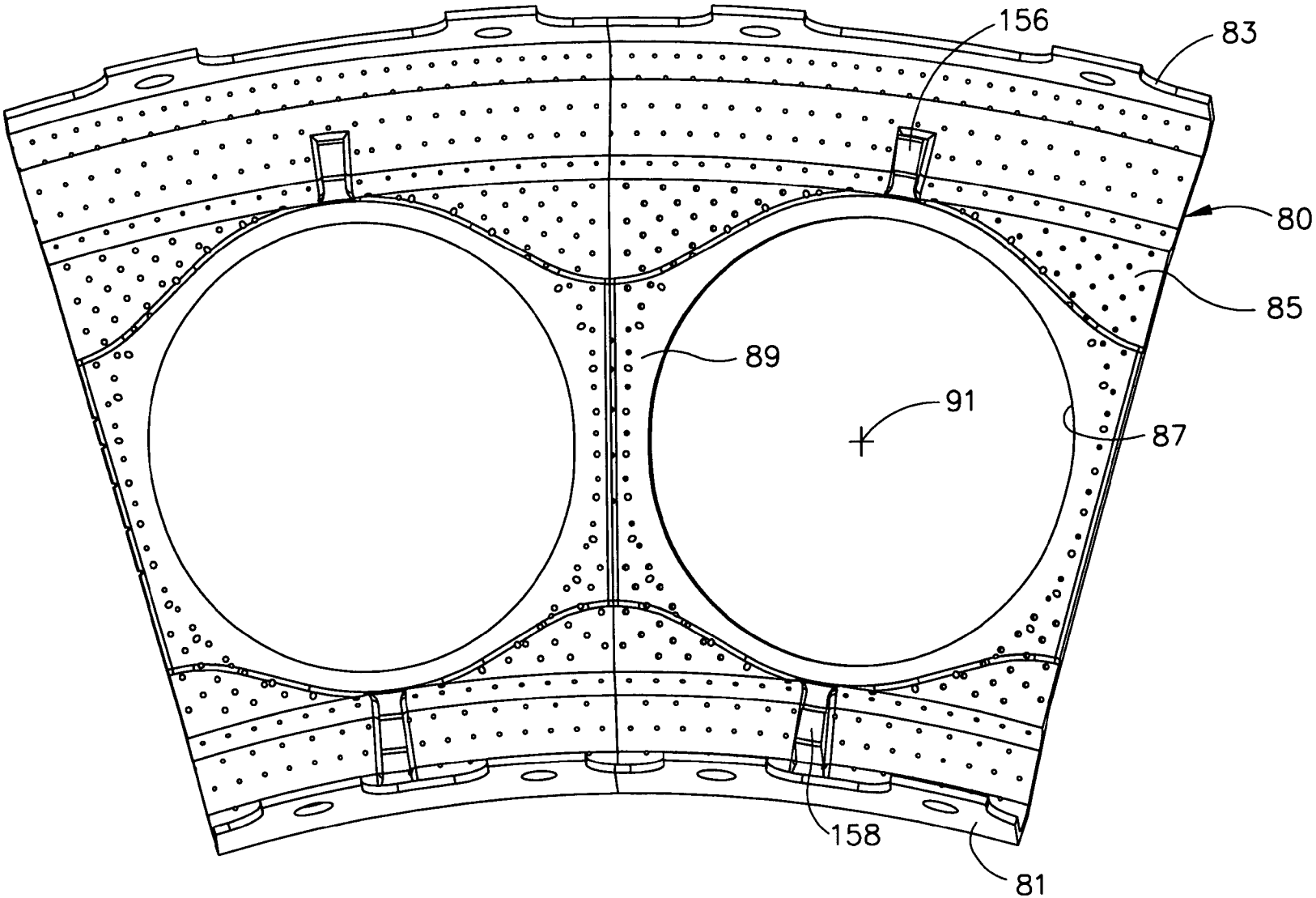
FIG. 5 is a partial front view of the combustor dome assembly depicted in FIG. 4, where the mixer assemblies have also been omitted for clarity.

A mixing assembly 100 in accordance with one embodiment of the present invention is shown in FIG. 3. Mixing assembly 100 preferably includes a pilot mixer 102, a main mixer 104, and a fuel manifold 106 positioned therebetween. More specifically, it will be seen that pilot mixer 102 preferably includes an annular pilot housing 108 having a hollow interior, a pilot fuel nozzle 110 mounted in housing 108 and adapted for dispensing droplets of fuel to the hollow interior of pilot housing 108. Further, pilot mixer preferably includes a first swirler 112 located at a radially inner position adjacent pilot fuel nozzle 110, a second swirler 114 located at a radially outer position from first swirler 112, and a splitter 116 positioned therebetween. Splitter 116 extends downstream of pilot fuel nozzle 110 to form a venturi 118 at a downstream portion. It will be understood that first and second pilot swirlers 112 and 114 are generally oriented parallel to a centerline axis 120 through mixing assembly 100 and include a plurality of vanes for swirling air traveling therethrough. Fuel and air are provided to pilot mixer 102 at all times during the engine operating cycle so that a primary combustion zone 122 is produced within a central portion of combustion chamber 62 (see FIG. 2). Fuel and air are provided to main mixer 104 during certain portions of the engine operating cycle so that a secondary combustion zone 178 is produced around primary combustion zone 122.

Main mixer 104 further includes an annular main housing 124 radially surrounding pilot housing 108 and defining an annular cavity 126, a plurality of fuel injection ports 128 which introduce fuel into annular cavity 126, and a swirler arrangement identified generally by numeral 130. More specifically, annular cavity 126 is preferably defined by an upstream wall 132 and an outer radial wall 134 of a swirler housing 136, and by an inner radial wall 138 of a centerbody outer shell 140.

It will be seen that inner radial wall 138 preferably also includes a ramp portion 142 located at a forward position along annular cavity 126. It will be appreciated that annular cavity 126 gently transitions from an upstream end 127 having a radial height 129 to a downstream end 131 having a second radial height 133.

Figure 6:
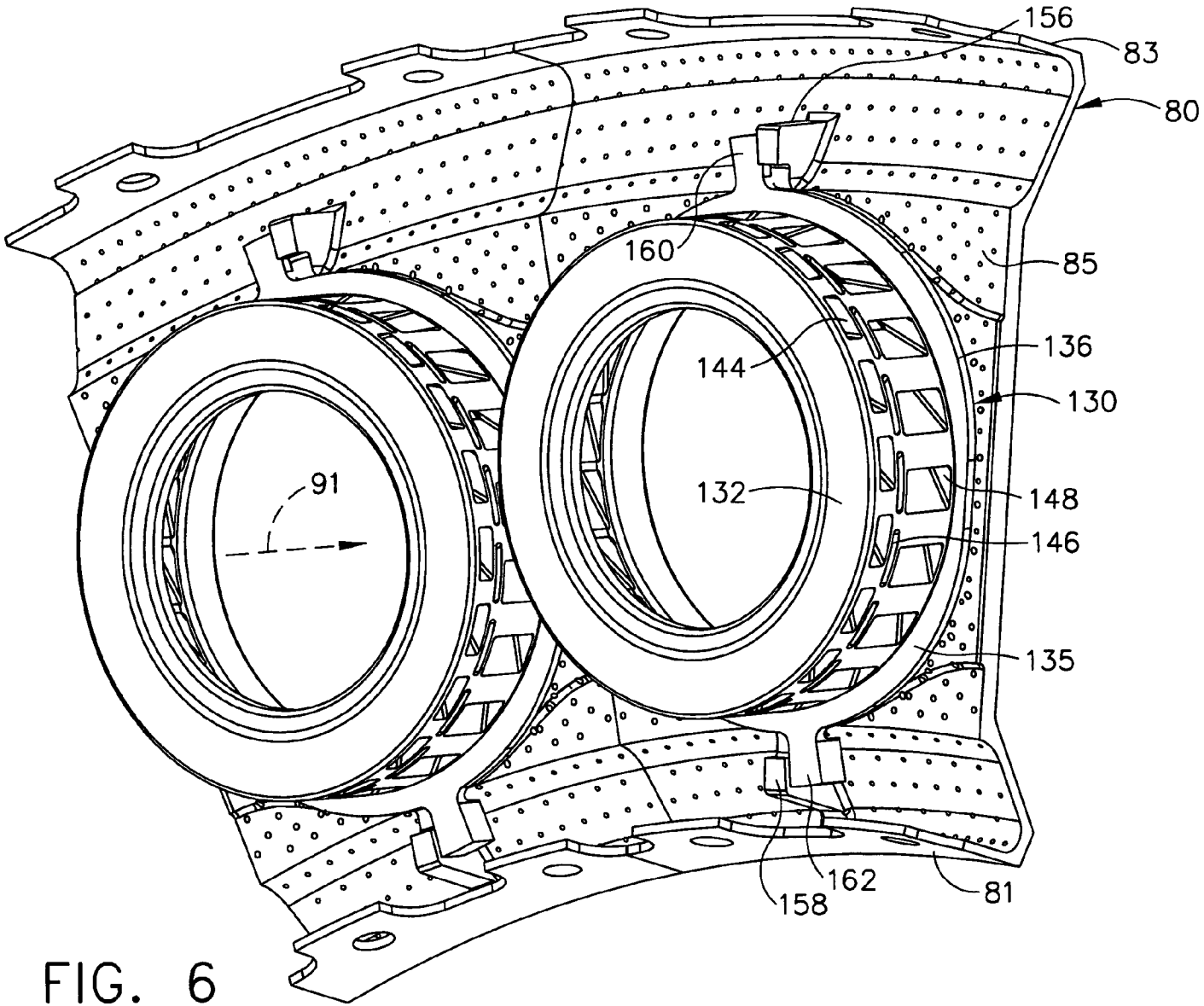
FIG. 6 is a partial front perspective view of the combustor dome assembly depicted in FIG. 4; and, FIG. 7 is an enlarged, partial front perspective view of the combustor dome assembly depicted in FIGS. 4 and 6, where a cross-section through the dome plate and mixer assembly is also shown.
Figure 7:
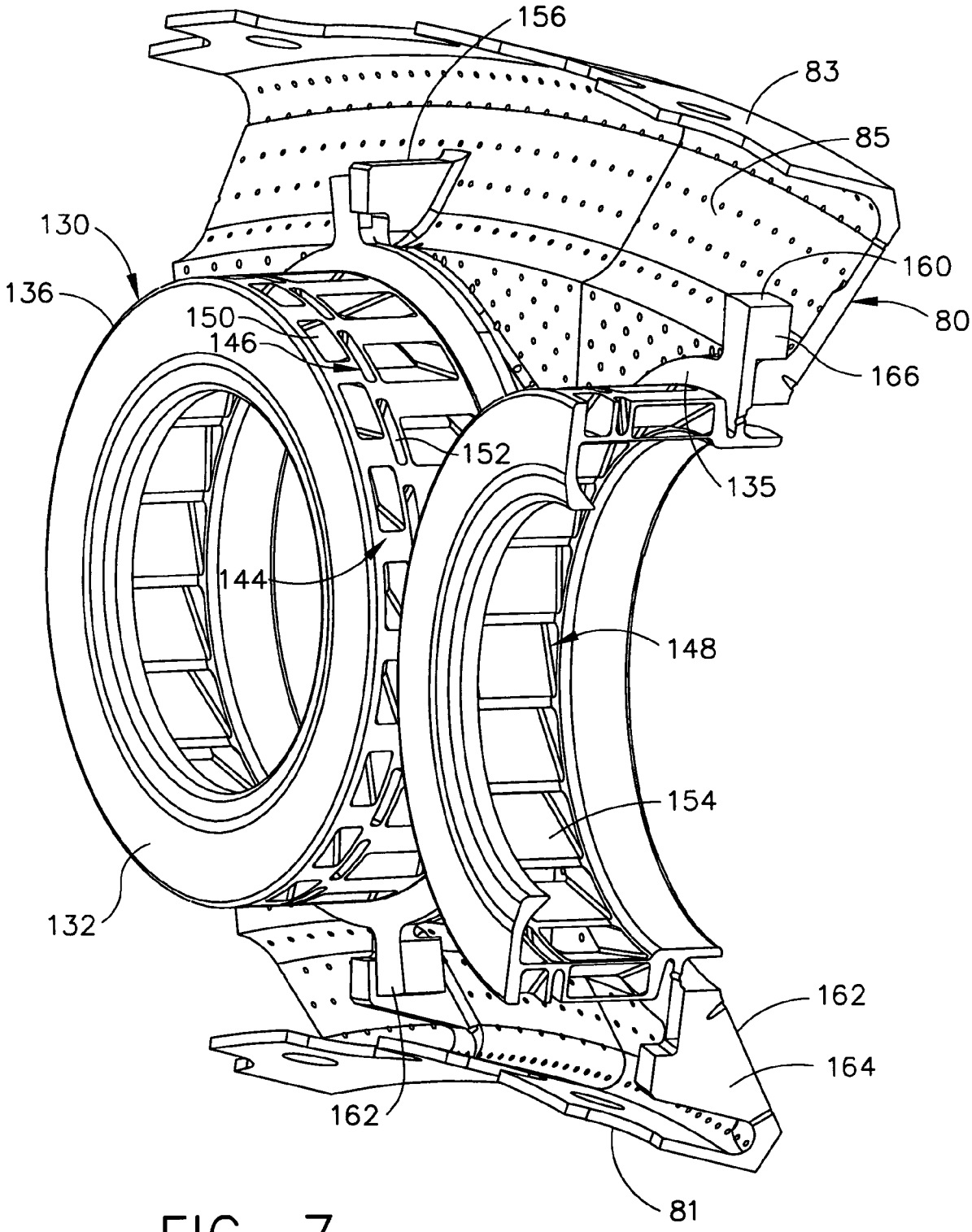

It will be seen in FIGS. 3, 6 and 7 that swirler arrangement 130 includes first, second and third swirlers 144, 146 and 148, respectively, positioned upstream from fuel injection ports 128. Each swirler is preferably oriented substantially radially to centerline axis 120 through mixer assembly 100, with first swirler 144 being positioned adjacent upstream wall 132, second swirler 146 being positioned immediately downstream of first swirler 144, and third swirler 148 being positioned immediately downstream of second swirler 146. In addition, each swirler has a plurality of vanes (identified by numerals 150, 152 and 154 for first swirler 144, second swirler 146, and third swirler 148, respectively) for swirling air traveling through such swirler to mix air and droplets of fuel dispensed by fuel injection ports 128. Other embodiments for the swirler arrangement may be utilized, as disclosed in patent applications entitled, "Mixer Assembly For Combustor Of A Gas Turbine Engine Having A Plurality Of Counter-Rotating Swirlers," having Ser. No. 11/188,596, "Swirler Arrangement For Mixer Assembly Of A Gas Turbine Engine Combustor Having Shaped Passages," having Ser. No. 11/188,595, and "Mixer Assembly For Combustor Of A Gas Turbine Engine Having A Main Mixer With Improved Fuel Penetration," having Ser. No. 11/188,598, each of which are filed concurrently herewith and are owned by the assignee of the present invention.

Fuel manifold 106, as stated above, is located between pilot mixer 102 and main mixer 104 and is in flow communication with a fuel supply. In particular, outer radial wall 138 of centerbody outer shell 140 forms an outer surface 170 of fuel manifold 106, and a shroud member 172 is configured to provide an inner surface 174 and an aft surface 176. Fuel injection ports 128 are in flow communication with fuel manifold and spaced circumferentially around centerbody outer shell 140. As shown and described in a patent application entitled "Mixer Assembly For Combustor Of A Gas Turbine Engine Having A Main Mixer With Improved Fuel Penetration," having Ser. No. 11/188,598, filed concurrently herewith and also owned by the assignee of the present invention, fuel injection ports 128 are preferably positioned axially adjacent ramp portion 142 of centerbody outer shell 140 so that fuel is provided in upstream end 127 of annular cavity 126. In this way, fuel is preferably mixed with the air in intense mixing region 168 before entering downstream end 131 of annular cavity 126. Regardless of the axial location of fuel injection ports 128, it is intended that the fuel be injected at least a specified distance into a middle radial portion of annular cavity 126 and away from the surface of inner wall 138.

Contrary to the above-identified patent applications, the present invention concerns the mechanical ability of mixer assembly 100 to move and interface with dome plate 80 instead of the mixing characteristics of fuel and air therein. More specifically, it will be seen in FIGS. 4-7 that dome plate 80 is annular in configuration and includes an inner portion 81, an outer portion 83, a forward surface 85 and a plurality of circumferentially spaced openings 87 formed therein. Accordingly, a radial section 89 is defined between each adjacent opening 87 in dome plate 80. As seen in FIG. 2, outer cowl 82 is preferably affixed to outer portion 83 of dome plate 80 at a downstream end 90, as well as to outer liner 76, by means of a plurality of connections 92 (e.g., bolts and nuts). Similarly, inner cowl 84 is preferably affixed to inner portion 81 of dome plate 80 at a downstream end 94, as well as to inner liner 78, by means of a plurality of connections 96 (bolts and nuts).

Swirler housing 136 of each swirler arrangement 130 is located between forward surface 85 of dome plate 80 and upstream ends 98 and 99 of outer and inner cowls 82 and 84, respectively, so as to be in substantial alignment with an opening 87 in dome plate 80. It will be appreciated that swirler housings 136 are not fixed or attached to any other component of mixer assembly 100, but are permitted to float freely in both a radial and axial direction with respect to a centerline axis 91 through each opening 87.

It is desirable, however, that swirler housings 136 be retained in position between dome plate 80 and cowl upstream ends 98 and 99 so that fuel nozzles 68 may be desirably received therein. Accordingly, at least one tab member extends from forward surface 85 of dome plate 80 adjacent each opening 87 and at least one corresponding tab member extends from each swirler housing 136 to restrict radial and axial movement thereof to a predetermined amount. Preferably, it will be noted that a first tab member 156 and a second tab member 158 extend from forward surface 85 of dome plate 80. It is preferred that tab members 156 and 158 be positioned opposite each other at approximately a radially outer position and a radially inner position, respectively. Similarly, first and second tab members 160 and 162 extend from a downstream portion 135 of outer wall 134 for swirler housing 136 and are spaced so that the respective tab members 160 and 162 are able to be aligned with tab members 156 and 158. In this way, swirler housing 136 is prevented from rotating. It will be appreciated that first and second tab members 156 and 158 may be attached to dome plate 80 (e.g., via brazing or the like) and/or formed integrally therewith (via forging and machining operations). First and second tab members 160 and 162 likewise may be attached to swirler housing 136 (e.g., via brazing or the like) and/or formed integrally with downstream portion 135 of outer wall 134.

As best seen in FIG. 7 with respect to second tab member 158, first and second tab members 156 and 158 preferably include a radial surface 164 associated therewith for accommodating a predetermined amount of radial growth and movement by swirler housing 136. Radial surface 164 also functions to accommodate a predetermined amount of axial growth and movement by swirler housing 136. In this regard, it will be appreciated that first and second tab members 160 and 162 of swirler housing 136 likewise include a corresponding radial surface 166 which interfaces with radial surface 164 of first and second tabs 156 and 158.

Having shown and described the preferred embodiment of the present invention, further adaptations of the combustor and the dome thereof can be accomplished by appropriate modifications by one of ordinary skill in the art without departing from the scope of the invention.

What is claimed is:

1. A combustor dome assembly for a gas turbine engine having a longitudinal centerline axis extending therethrough, comprising:

(a) an annular dome plate having an inner portion, an outer portion, a forward surface and a plurality of circumferentially spaced openings formed therein, wherein a radial section is defined between each adjacent opening;

(b) a mixer assembly located upstream of and in substantial alignment with each of said openings in said dome plate, said mixer assembly including a an upstream portion and a downstream portion;

(c) a mechanism to prevent rotation of each said mixer assembly, said mechanism further comprising;

(1) a first pair of tab members extending upstream from said forward surface of said dome plate adjacent each said opening; and (2) a second pair of tab members extending outwardly from said downstream portion of each said mixer assembly, wherein said dome plate tab members interface with said mixer assembly tab members to prevent rotation of each said mixer assembly;

wherein each said mixer assembly is retained in a manner so as to be movable in a radial and axial direction without obstructing said radial sections of said dome plate.

2. The combustor dome assembly of claim 1, wherein a first tab matter of each said pair of dome plate tab members extends upstream from said forward surface of said dome plate adjacent said outer portion thereof.

3. The combustor dome assembly of claim 2, wherein a second tab member of each said pair of dome plate tab members extends upstream from said forward surface of said dome plate adjacent said inner portion thereof.

4. The combustor dome assembly of claim 3, wherein said first and second tab members of each pair of said dome plate tab members extend upstream from said forward surface of said dome plate so as to be positioned substantially opposite each other.

5. The combustor dome assembly of claim 1, wherein said dome plate tab members are formed integrally with said forward surface thereof.

6. The combustor dome assembly of claim 1, wherein said mixer assembly tab members are formed integrally with said downstream portion of said mixer assembly.

7. The combustor dome assembly of claim 1, wherein a predetermined minimum contact area between said mixer assembly tab members and said dome plate tab members is maintained.

8. The combustor dome assembly of claim 1, said dome plate tab matters and said mixer assembly tab members being sized to accommodate thermal growth and movement by each said mixer assembly during operation of said gas turbine engine.

9. The combustor dome assembly of claim 1, wherein said dome plate tab members are configured to permit radial growth of said mixer assembly.

10. The combustor dome assembly of claim 1, wherein said mixer assembly tab members have a width at least as great as a width for said dome plate tab members.

11. The combustor dome assembly of claim 1, wherein said dome plate tab members have a thickness greater than a thickness for said mixer assembly tab members.

12. The combustor dome assembly of claim 1, said mixer assembly further comprising:

(a) a pilot mixer including an annular pilot housing having a hollow interior and a pilot fuel nozzle mounted in said housing and adapted for dispensing droplets of fuel to said hollow interior of said pilot housing;

(b) a main mixer including:

(1) a main housing surrounding said pilot housing and defining an annular cavity;

(2) a plurality of fuel injection ports for introducing fuel into said cavity; and, (3) a swirler arrangement including a swirler housing having at least one swirler incorporated therein positioned upstream from said fuel injection ports, wherein each swirler of said swirler arrangement has a plurality of vanes for swirling air traveling through such swirler to mix air and said droplets of fuel dispensed by said fuel injection ports; and, (c) a fuel manifold positioned between said pilot mixer and said main mixer, wherein said plurality of fuel injection ports for introducing fuel into said main mixer cavity are in flow communication with said fuel manifold;

wherein said second pair of tab members extend outwardly from a downstream portion of each said swirler housing.

13. The combustor dome assembly of claim 12, said swirler arrangement further comprising a swirler oriented substantially radially to a centerline axis through said mixer assembly, wherein said second pair of tab members extend from said swirler housing aft thereof.

14. The combustor dome assembly of claim 1, wherein each mixer assembly is substantially aligned circumferentially with respect to a corresponding opening in said dome plate.

15. The combustor dome assembly of claim 1, wherein positioning of each said mixer assembly to said dome plate is independent of all other said mixer assemblies.

16. The combustor dome assembly of claim 1, wherein no direct connection between adjacent mixer assemblies is provided.

* * * * *